US006030938A

United States Patent [19]

Wo et al.

[11] Patent Number: 6,030,938

[45] Date of Patent: Feb. 29, 2000

[54] PROCESS FOR MAKING SALT-FREE AMPHOTERICS WITH HIGH MONO AMPHOPROPIONATE CONTENT

[75] Inventors: Shiming Wo, Hightstown; Ji Li, East Windsor; Mohamed Hashem, Robbinsville; Rastko Vukov, Princeton, all of N.J.

[73] Assignee: Rhodia Inc., Cranbury, N.J.

[21] Appl. No.: 08/775,483

[22] Filed: Dec. 31, 1996

[51] Int. Cl.[7] ..... C11D 1/10

[52] U.S. Cl. ..... 510/490; 510/501; 554/63; 554/66

[58] Field of Search ..... 510/490, 501; 554/63, 66, 69, 88

[56] References Cited

U.S. PATENT DOCUMENTS

| | | | |
|---|---|---|---|
| 2,374,354 | 4/1945 | Kaplan | 260/309.6 |
| 2,524,218 | 10/1950 | Bersworth | 252/117 |
| 2,530,147 | 11/1950 | Bersworth | 260/404.5 |
| 2,532,391 | 12/1950 | Bersworth | 260/404.5 |
| 2,568,876 | 9/1951 | White et al. | 106/14 |
| 2,574,537 | 11/1951 | Degroote et al. | 260/309.6 |
| 2,773,068 | 12/1956 | Mannheimer | 260/309.6 |
| 2,781,354 | 2/1957 | Mannheimer | 260/309.6 |
| 2,820,043 | 1/1958 | Rainey et al. | 260/309.6 |
| 2,846,440 | 8/1958 | Hughes | 260/309.6 |
| 3,152,080 | 10/1964 | Stuart et al. | 252/51.5 |
| 3,187,003 | 6/1965 | McBride | 260/309.6 |
| 3,244,724 | 4/1966 | Guttmann | 260/309.6 |
| 3,555,041 | 1/1971 | Katz | 260/309.6 |
| 3,620,807 | 11/1971 | Murray | 117/66 |
| 3,629,104 | 12/1971 | Maddox | 252/8.55 E |
| 3,941,817 | 3/1976 | Chakrabarti et al. | 260/404.5 |
| 4,705,843 | 11/1987 | Stammann et al. | 528/212 |
| 4,732,692 | 3/1988 | Zabotto et al. | 252/106 |
| 5,175,220 | 12/1992 | Burba et al. | 525/526 |
| 5,288,873 | 2/1994 | Su et al. | 548/323.5 |
| 5,322,630 | 6/1994 | Williams et al. | 252/8.553 |
| 5,569,767 | 10/1996 | Uphues et al. | 548/352.1 |
| 5,716,921 | 2/1998 | Neumiller | 510/181 |

FOREIGN PATENT DOCUMENTS

| | | |
|---|---|---|
| PCT/JP95/01246 | 1/1996 | Japan . |
| 1078101 | 8/1967 | United Kingdom . |
| 1149140 | 4/1969 | United Kingdom . |

OTHER PUBLICATIONS

Fischer, et al. Tenside Surf. Det. 31, No. 2 (1994) 99–108.
Rosen, M. Geminis: A New Generation of Surfactants Chemtech 30–33 Mar. (1993).
Martell, A., et al. Jacs 73, (12/50) 5357–5361.

*Primary Examiner*—Yogendra Gupta
*Assistant Examiner*—John R. Hardee
*Attorney, Agent, or Firm*—John A. Shedden; Craig M. Bell; John Daniel Wood

[57] ABSTRACT

A novel, salt-free monoamphopropionate amphoteric surfactant is prepared in yields of from 75% to 80%, from a reaction comprising an imidazoline and a mixture of acrylic acid and sodium acrylate in an aqueous medium. The acrylic acid/sodium acrylate mixture is comprised of the two components in a range of molar ratios of from about 1:6 to about 1:3, respectively, and by replacing methyl acrylate, the reaction does away with the production of methanol which is an unwanted, hazardous and toxic byproduct. The imidazoline reacts in amounts in excess of 90% resulting in the highly pure yields and any left over unreacted acrylic acid can be easily removed by treating it with sodium bisulfate.

16 Claims, No Drawings

PROCESS FOR MAKING SALT-FREE AMPHOTERICS WITH HIGH MONO AMPHOPROPIONATE CONTENT

FIELD OF THE INVENTION

The present invention relates generally to surfactants and cleaning compositions useful in cosmetic and personal care applications such as soaps shampoos, toiletries and the like. In particular, the present invention relates to the preparation of these compositions and an improved process that is both user and environmental friendly.

BACKGROUND OF THE INVENTION

Surfactants, or surface active agents, are useful in cleaning compositions as they reduce the intermolecular attraction of one compound or material from that of another. In other words, they reduce the surface tension that exists between dirt, oil or grease and the skin, hair, or some other inert material such as porcelain, fabric, hard surfaces and the like. In so doing, the dirt or grease is released from the surface of the second material which is consequently cleaned.

There are three basic types of surfactant and many different species of each. Detergents reduce the surface tension of water and specifically exert emulsifying action at oil-water interfaces and in this way function to remove soils. Emulsifiers are basically a type of detergent and hold two or more liquids in suspension. Wetting agents reduce the surface tension of water whereby it is able to more easily penetrate or spread over the surface of another material.

Surfactants can also be classified in terms of their charge. Anionic surfactants are negatively charged, cationic are positively charged, non-ionic possess no charge while amphoteric surfactants can be either positive or negatively charged depending on their environment and have the capacity of acting as either an acid or a base depending on the pH of the surrounding solution. Again, there are many different species of each group and each may function in a different manner. Imidazoline-derived amphoteric surfactants are generally characterized by their relative mildness, which makes them ideal for applications in personal care compositions such as baby shampoo formulations. Moreover, they tend to be stable and effective over a wide pH range, and this is a useful property for many alkaline and acid cleaners used in specialty cleaner applications.

U.S. Pat. No. 3,187,003 to McBride discloses a process for the preparation of zwitterions of 1-(2-aminoethylimidazolines) that are useful as oil stabilizers, grease additives, fabric anti-static agents and the like. An imidazoline having an aminoethyl substituent is reacted with an α-β-unsaturated acid of from 12 to 22 carbon atoms.

U.S. Pat. No. 2,820,043 to Rafney et al. discloses a process for the preparation of imidazoline propionic acid derivatives which are amphoteric surfactants by nature and are useful as wetting agents, penetrating agents, emulsifying agents, dispersing and cleansing agents. They are allegedly useful over a wide range of pH and are prepared by reacting a 2-hydrocarbon substituted imidazoline with a lower alkyl acrylate in the presence of heat, thus forming the lower alkyl ester of 2-substituted imidazoline propionic acid which is then hydrolyzed.

U.S. Pat. No. 3,555,041 to Katz discloses a class of amphoteric imidazoline surfactants having effective surfactant properties over a wide range of pH values. These surfactants are produced by reacting long chain imidazoline compounds containing amino-, alkyl-, or hydroxyalkyl-substituted groups with acrylonitrile, methyl acrylate or beta-propiolactone. Preferably, methyl acrylate is used.

Finally, U.K. Patent No. 1,078,101 to Arndt teaches a class of amphoteric imidazolines known as 2-R-imidazoline-1-ethylene-2-oxy-propanoic acids prepared by the condensation reaction of aminoethyl ethanolamine and a fatty acid to yield an imidazoline intermediate which is then reacted with acrylic acid to yield the final product. The compounds are asserted to be useful as emulsifiers, detergents, wetting and surface active agents over a wide range of pH.

Imidazoline-based amphoteric surfactants can be divided into two groups: salt-containing and salt-free. Salt-containing imidazoline amphoteric surfactants having the general structure as shown in FIG. 1 are usually made from the condensation reaction of imidazoline and sodium monochloroacetate, while sodium chloride is produced as a by-product.

Figure 1

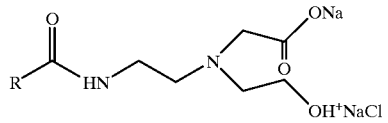

Salt-Containing Amphoacetate

Salt-free amphoterics such as monoamphopropionate as shown in FIG. 2 have several advantages over the salt-containing counterparts in industrial applications. Salt-free amphoterics can be made by the Michael addition reaction between imidazoline with either methyl acrylate or acrylic acid under anhydrous conditions, followed by alkaline hydrolysis. Unfortunately, the reactions usually give complex mixtures as suggested by NMR, capillary electrophoresis and HPLC. Alternatively, the reactions can be carried out in aqueous media but the conversion is low. It would therefore be highly desirable to produce a salt-free amphoteric from imidazoline and acrylic acid with high amounts of mono-amphopropionate as shown in FIG. 2.

Figure 2

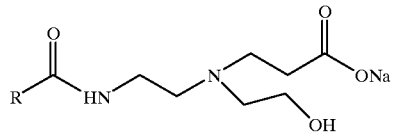

Salt Free Amphopropionate

Wherein R=$C_{11}$–$C_{17}$ alkane

The use of acrylic acid as a reactant compound as opposed to methyl acrylate provides a number of benefits. Acrylic acid for example, has a higher flash point and is therefore safer and easier to work with. The compound also has a far less objectionable odor.

Of perhaps greater value in the process of the present invention, is that the production of salt-free amphoteric surfactants such as monoamphopropionate does not generate methanol as a by-product. Methanol is listed as a hazardous chemical by the Environmental Protection Agency (EPA). Most amphopropionate surfactants produced using methyl acrylate contain from 2.0% to over 5.0% methanol as a by-product. Storage of methyl acrylate requires expensive tanks as well as effective ventilation and absorbing equipment for removal of the vapor.

Another major problem with the production of salt-free amphopropionates using the processes known in the art is the relatively low yields of monoamphopropionates achievable. Reacting an imidazoline coco-condensate with methyl acrylate produces salt-free monoamphopropionate in yields of just 20%–25%. This is also a very impure product with up to seven (7) different compounds produced in the reaction mixture.

SUMMARY OF THE INVENTION

An improved process for the production of salt-free amphoteric surfactants in high yields comprises the condensation reaction of imadazoline with a mixture of acrylic acid and sodium acrylate in a molar ratio of about 1:3, respectively. The reaction is carried out in aqueous medium at elevated temperatures of from about 85° C. to 100° C.

DETAILED DESCRIPTION OF THE INVENTION

It is well known that imidazoline readily undergoes Michael addition reactions with methyl acrylate or acrylic acid under anhydrous conditions. Carbon-13 NMR analyses suggest that the reaction product after hydrolysis with sodium hydroxide contains many components rather than a single compound, the desired amphopropionate as shown in FIG. 2. One possible explanation as to why Michael addition reactions afford complex mixtures is outlined in Scheme 1. In the first step, Michael addition may take place on the $sp^2$ nitrogen to give intermediate 2*a*, which is stabilized by the formation of 2*b* through the resonance mechanism.

Scheme 1

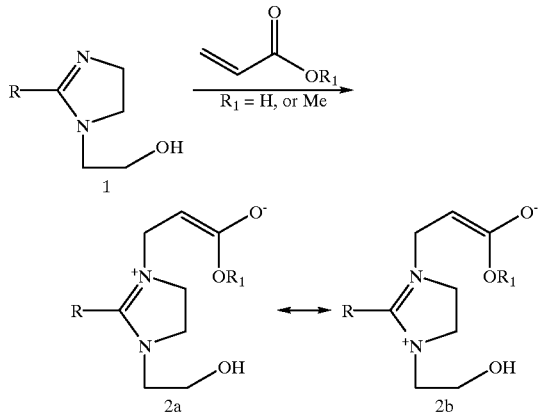

Hydrolysis of the adduct (2*a*) and (2*b*) by sodium hydroxide gives two monopropionates (3) and (4) upon cleavage of either one of the two C—N bonds. In the presence of excess alkylating reagents, (3) and (4) can be further converted to dipropionates (5) and (6), respectively. It was found that in the case of methyl acrylate, besides the nitrogen atoms in the imidazoline ring, the hydroxyl group underwent a Michael addition reaction as well. This is evidenced by the appearance of carbon-13 signals in the regions of 67 ppm.

Scheme 1b.

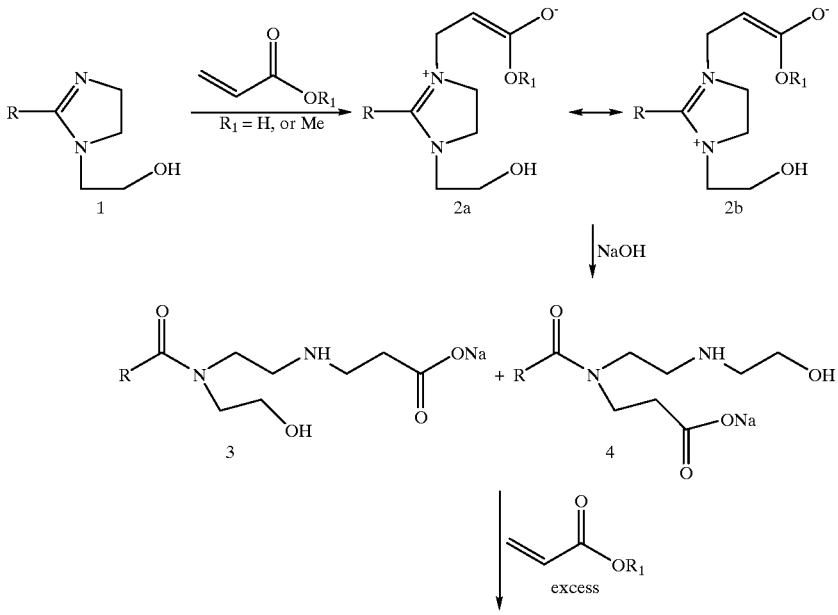

-continued

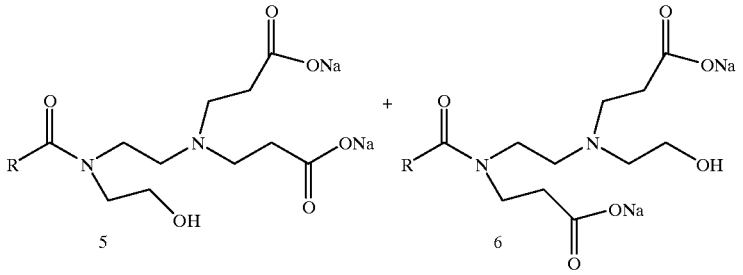

It is possible for the alkylation to occur on the $sp^3$ nitrogen atom as well. However, the resulting intermediate (7) as shown in Scheme 2 is less stable than intermediate (2) which is stabilized by resonance structures. Consequently, the desired amphopropionate surfactant is just a minor component in the mixture.

Scheme 2

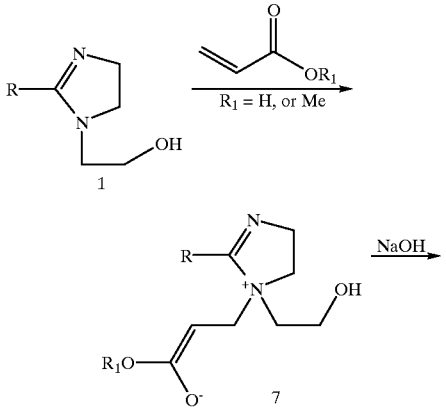

-continued

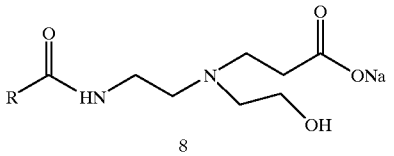

Product obtained by running the reaction in aqueous media is expected to contain more of (8) since imidazoline is known to undergo hydrolysis by water to give amidoamine (9) together with small amount of 10, which will then react with an alkylating reagent on the amine nitrogen to give (8) and (11) respectively (see Scheme 3.) The conversion of imidazoline to the product is low and the finished product contains significant amount of unreacted amidoamine (9).

Scheme 3

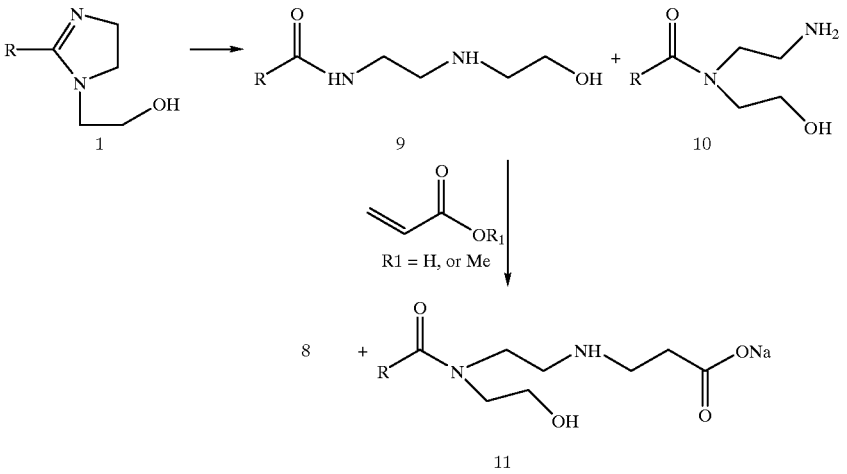

The present invention is a process to produce a salt-free amphoteric surfactant with a high content of monoamphopropionate (8) from the readily available acrylic acid and coco-imidazoline. Clearly, a Michael addition reaction has to be utilized to produce amphopropionate (8) from acrylic acid and coco-imidazoline. However, treatment of imidazoline directly with acrylic acid would give a salt through a typical acid-base type reaction which can compete with the Michael addition reaction. One way to overcome this problem is through the use of sodium acrylate.

The Michael addition with amidoamine (9) would first give intermediate (12) as shown in Scheme 4, which then undergoes rearrangement to give (8) in relatively high yields.

Scheme 4

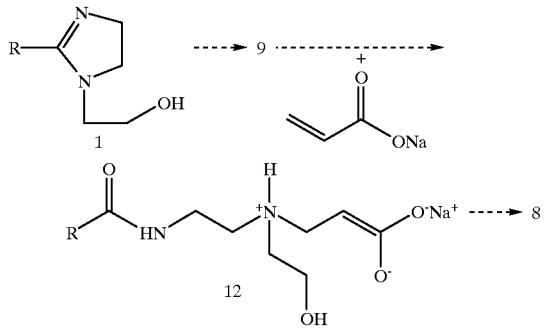

The present invention then involves the preparation of a salt-free amphoproprionate surfactant in high yields of monoamphoproprionates with few impurities and other undesirable by-products. The process generally comprises reacting an imidazoline with a mixture of acrylic acid and sodium acrylate in an aqueous medium at elevated temperatures. The use of acrylic acid in place of methyl acrylate enables the reaction to be run without the production of methanol, an otherwise hazardous by-product. In the past, methanol was produced in amounts of up to 2.0% to 5.0% by weight of the total end product mixture.

By removing methanol as a by-product altogether, salt-free amphoteric surfactants can be produced which can be incorporated into personal care items and, in particular, cosmetic compositions where they afford superior cleaning efficacy with little to no irritation. These surfactants can also be formulated in hypoallergenic compositions which are growing in demand worldwide.

The Michael reaction occurs in an aqueous medium at elevated temperatures. The imidazoline and acrylic acid/sodium acrylate mixture are combined in a molar ratio of 1:1, i.e, equal parts imidazoline and acid/acrylate mixture. The mixture itself is comprised of acrylic acid and sodium acrylate in molar weight ratios of from about 1:6 to about 1:3. Preferably the two compounds are mixed in an amount of 25 parts acrylic acid to 75 parts sodium acrylate. The compounds are mixed together in water prior to the addition of the imidazoline. Imidazoline derivatives useful in the practice of the present invention are prepared from 2-(2-aminoethylamino)ethanol and fatty acids. Examples of fatty acids can include coconut oil fatty acids, caprylic, capric, lauric, myristic, polmitic and stearic acids.

When lauric imidazoline (Structure 1; $R{=}C_{11}H_{23}$) was treated with sodium acrylate prepared from acrylic acid and sodium hydroxide in aqueous media at 70° C., the desired Michael addition reaction did not occur after 5 hr. Carbon-13 NMR showed that imidazoline was hydrolyzed to amidoamine after 1 hr. under the reaction conditions employed. The reaction mixture was then heated to 90° C. and the temperature was maintained for 20 hrs. A Carbon-13 NMR spectrum of the reaction product showed the desired Michael addition reaction had occurred and the amphopropionate surfactant (Structure 8) was formed in 37% yield based on imidazoline. The structure assignment for 8 was based on the comparison of its $^{13}$C-NMR spectrum with that of the well-known amphoacetate as shown in FIG. 1.

The following examples are designed to better disclose the invention with more particularity in an effort to more specifically enable one to practice the process of the present invention. They are for illustrative purposes only however, and it is recognized that minor changes and alterations may be made thereto that are not contemplated herein. It is to be understood that to the extent that any such changes or alteration do not materially affect the final reaction product or results, they are to be considered as falling within the spirit and scope of the invention as defined by the claims that follow.

EXAMPLE I

To a four-neck round bottom flask equipped with a stirrer, thermometer and dropping funnel was added 268 g (1.0 mol) of coco-imidazoline, 400 g of water and a mixture of acrylic acid and sodium acrylate that was prepared in a separate vessel by adding 72 g (1.0 mol) of acrylic acid to 24 g of 50% NaOH (0.3 mol) in 200 g of water with stirring and cooling. The reaction mixture was heated to 90° C. and continued for 20 hr.

The product analyzed was 38.0% solid. Analysis by carbon-13 NMR indicated the reaction produced monoamphopropionate (8) in a 40% yield based on the amount of coco-imidazoline and 20% of unreacted amidoamine (9).

EXAMPLE II

This example illustrates that the yield of monoamphopropionate (8) can be improved by varying the ratio of acrylic acid to sodium acrylate.

The process of Example 1 was repeated using a mixture of acrylic acid and sodium acrylate prepared from 72 g (1.0 mole) of acrylic acid and 60 g of 50% sodium hydroxide (0.75 mol) in 200 g of water. The yield of monoamphopropionate (8) was improved to 52% based on the amount of coco-imidazoline.

EXAMPLE III

This example demonstrates that using solely sodium acrylate above does not increase the yield of monoamphopropionate (8).

The process of Example 1 was followed using sodium acrylate prepared from 72 g (1.0 mol) of acrylate acid and 80 g of 50% sodium hydroxide (1.0 mol) in 200 g of water. The yield of amphopropionate (8) was 37% based on the amount of coco-imidazoline.

EXAMPLE IV

This example describes the procedure wherein the imidazoline is first converted to the amidoamine by sodium hydroxide and then alkylated by a mixture of acrylic acid and sodium acrylate. It also shows that the yield of amphopropionate (8) can be further increased by using an excess amount of a mixture of acrylic acid and sodium acrylate.

To a four-neck round bottom flask equipped with a stirrer, thermometer and dropping funnel was added 268 g (1.0 mol)

of coco-imidazoline, 4 g of 50% NaOH (0.05 mol) aqueous solution and 200 g of water. The resulting mixture was heated at 85° C. for 1 hr. with stirring. In a separate container, a mixture of acrylic acid and sodium acrylic was prepared by adding 90 g (1.25 mol) of acrylic acid to 71 g of 50% NaOH (0.89 mol) in 200 g of water with stirring and cooling. Two hundred grams of water was added to the reaction flask, followed by the mixture of acrylic acid and sodium acrylate. Heating was continued for another 16 hr and the reaction temperature was maintained at 85° C.

The product analyzed was 38.4% solids. Analysis by carbon-13 NMR indicated that an 80% yield of mono-amphopropionate (8), based on the amount of imidazoline was obtained together with less than 10% of unreacted amidoamine (9) and about 10% of unidentified components, probably dipropionates such as (5) and (6). The high content of monoamphopropionate (8) in the product compared to a commercial product such as Miranol C2M SF from Rhone-Poulenc, Inc., was also confirmed by capillary electrophoresis. Under these conditions, the reaction conversion with respect to amidoamine was shown to be 90%. About 25% of the acrylate mixture was left unconsumed at the end of reaction as determined by NMR as well as liquid chromatography. Although it is possible to get a higher reaction conversion by using a larger excess of acrylate mixture, it is certainly not desirable to have a large access of unreacted acrylate in the finished product. The finished product may contain up to 10% of dipropionates such as structures (5) and (6).

The unconsumed acrylate can be easily removed, as desired, by the treatment with an stoichiometric amount of sodium bisulfite at 85° C. for 1 hour. The possible acrylic acid reformation, via a reversed Michael addition reaction, does not occur at a noticeable rate over a three-month period. This is supported by the fact that the finished product contains less than 100 ppm acrylic acid after being treated with sodium bisulfite was found to contain still less than 100 ppm of acrylic acid after 3 months at room temperature. Preferably, the reaction is carried out in the presence of air, otherwise the finished product can become cloudy which is attributed to the polymerization of acrylic acid or sodium acrylate.

EXAMPLE V

The functional surfactant characteristics of the salt-free amphoterics of the present invention were compared to those of a commercially available amphoteric, Miranol C2M SF® (Rhone-Poulenc Inc., Monmouth Jct, N.J.) a sodium coco-amphopropionate. The surface active properties of the salt-free amphoacetate were compared both before and after the amphoacetate was treated with sodium bisulfite. The results are summarized in Table 1.

TABLE 1

Surface Properties of Miranol SF and Salt-Free Amphopropionate

| Surfactant | CMC (mole/l) | $\gamma_{cmc}$ (dynes/cm) | pC-20 | Foams Height (mm) (0--> 5 min) | Wetting Time (sec) |
|---|---|---|---|---|---|
| Miranol SF | $1.0 \times 10^{-4}$ | 31.5 | 5.1 | 142 --> 132 | 60 |
| Amphopropionate before $Na_2SO_3$ | $4.0 \times 10^{-5}$ | 28.9 | 5.6 | 153 --> 138 | 38 |
| Amphopropionate after $Na_2SO_3$ | $1.0 \times 10^{-5}$ | 27.5 | 5.5 | 148 --> 138 | 47 |

As shown in Table 2, compared to Miranol C2M SF, the salt-free amphopropionate either treated or untreated with sodium bisulfite is more efficient in reducing the surface tension and forming micelles. The new amphoteric surfactant also exhibits better foaming and wetting properties than Miranol C2M SF.

EXAMPLE VI

This example demonstrates an alternative procedure to that set forth in Example 1. Imidazoline was added to sodium acrylate so that a separate vessel for the preparation of acrylic acid/sodium acrylate mixture can be avoided.

To a four neck round bottom flask containing 75 g of 50% NaOH (0.94 mol) and 300 g of water was added 63.9 g (0.89 mol) of acrylic acid, followed by 268 g of coco-imidazoline. The resulting mixture was heated at 65° C. for 1 hr with stirring, and then 26.1 g (0.36 mol) of acrylic acid was added. The reaction temperature was allowed to increase to 90° C. and maintained at this temperature for 20 hr.

What is claimed is:

1. An amphopropionate surfactant composition, free of any methanol residues and free of inorganic salt contaminants or residues consisting essentially of a compound having the structure:

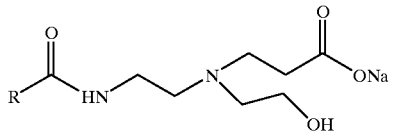

wherein R═$C_7$–$C_{17}$ alkyl.

2. The inorganic salt-free amphopropionate surfactant composition produced by the process consisting essentially of:

a. reacting an imidazoline compound with a mixture consisting of an acrylic acid and sodium acrylate in aqueous solution at elevated temperature.

3. The inorganic salt-free amphopropionate surfactant composition of claim 2 wherein said acrylic acid and sodium acrylate are mixed together in a range of molar ratios of from about 1:6 to about 1:3, respectively.

4. The inorganic salt-free amphopropionate surfactant composition of claim 3 wherein said imidazoline is selected from the group consisting of lauric imidazoline, caprylic imidazoline, capric imidazoline, myristic imidazoline, palmitic imidazoline, stearic imidazoline, their derivatives and mixtures thereof.

5. The inorganic salt-free amphopropionate surfactant composition of claim 4 wherein said reaction is run at a temperature of from about 80° C. to about 100° C.

6. The salt-free amphopropionate surfactant composition of claim 5 wherein said reaction is run at a temperature of from about 85° to about 95° C.

7. The salt-free amphopropionate surfactant composition of claim 6 wherein said process is carried out without the production of methanol.

8. The inorganic salt-free amphopropionate surfactant composition of claim 7 wherein said process further comprises the subsequent addition of sodium bisulfite.

9. A process for the preparation of a salt-free amphopropionate surfactant composition consisting essentially of the reaction of an imidazoline compound with a mixture of acrylic acid and sodium acrylate in an aqueous medium at elevated temperatures.

10. The process of claim 8 wherein said imidazoline compound is selected from the group consisting of lauric imidazoline caprylic imidazoline, capric imidazoline, myristic imidazoline, palmitic imidazoline, stearic imidazoline, their derivatives and mixtures thereof.

11. The process of claim 10 wherein said acrylic acid and sodium acrylate are incorporated in said mixture in a range of molar ratios of from about 1:6 to about 1:3, respectively.

12. The process of claim 11 wherein said imidazoline compound is reacted with said acrylic acid/sodium acrylate mixture in a molar ratio of from about 1:1 to 1:1.25.

13. The process of claim 12 wherein said reaction is run at a temperature of from about 85° C. to about 100° C.

14. The process of claim 13 wherein said reaction is run at a temperature of from about 85° C. to about 95° C.

15. The process of claim 14 further comprising the subsequent addition of sodium bisulfite in an amount sufficient to remove any excess acrylic acid.

16. The process of claim 15 wherein said reaction is carried out without the production of methanol.

* * * * *